US008206008B2

(12) United States Patent
Quadri

(10) Patent No.: US 8,206,008 B2
(45) Date of Patent: Jun. 26, 2012

(54) STAGE LIGHT

(75) Inventor: Pasquale Quadri, Torre de' Roveri (IT)

(73) Assignee: Clay Paky S.p.A. (IT)

( * ) Notice: Subject to any disclaimer, the term of this patent is extended or adjusted under 35 U.S.C. 154(b) by 133 days.

(21) Appl. No.: 12/554,307

(22) Filed: Sep. 4, 2009

(65) Prior Publication Data

US 2010/0061100 A1 Mar. 11, 2010

(30) Foreign Application Priority Data

Sep. 5, 2008 (IT) ..... MI08A001590

(51) Int. Cl.
*F21V 17/02* (2006.01)
*F21V 9/00* (2006.01)

(52) U.S. Cl. ..... 362/282; 362/322; 362/293

(58) Field of Classification Search ..... 362/277, 362/293, 280, 281, 282, 284, 322, 323
See application file for complete search history.

(56) References Cited

U.S. PATENT DOCUMENTS

| | | | | |
|---|---|---|---|---|
| 3,316,398 | A * | 4/1967 | Dayton et al. | 362/277 |
| 5,825,548 | A * | 10/1998 | Bornhorst et al. | 359/578 |
| 5,934,794 | A * | 8/1999 | Hutton | 362/283 |
| 6,113,252 | A * | 9/2000 | Arlitt et al. | 362/365 |
| 6,220,730 | B1 * | 4/2001 | Hewlett et al. | 362/297 |
| 6,350,042 | B1 | 2/2002 | Lai | |
| 6,744,693 | B2 * | 6/2004 | Brockmann et al. | 362/321 |
| 6,834,982 | B2 * | 12/2004 | Dedoro | 362/268 |
| 2002/0060911 | A1 | 5/2002 | Brockmann et al. | |
| 2003/0021119 | A1 * | 1/2003 | Blusseau et al. | 362/277 |

FOREIGN PATENT DOCUMENTS

| | | | |
|---|---|---|---|
| EP | 1 167 868 | A2 | 1/2002 |
| EP | 1 384 941 | A2 | 1/2004 |
| EP | 1384941 | A2 | 1/2004 |
| WO | 01/84043 | A1 | 11/2001 |
| WO | 2007/098720 | A1 | 9/2007 |
| WO | 2007/122459 | A2 | 11/2007 |

OTHER PUBLICATIONS

International Search Report dated Dec. 22, 2009 as issued in Foreign Application No. GB0915498.0.
Examination Report for United Kingdom Patent Application No. GB0915498.0 dated Feb. 10, 2012.

* cited by examiner

*Primary Examiner* — Peggy A. Neils
(74) *Attorney, Agent, or Firm* — Workman Nydegger

(57) ABSTRACT

A stage light fixture is provided with a main body extending along a longitudinal axis; with a light source arranged inside the main body at a closed end of the main body and adapted to emit a light beam substantially along the axis; with an objective lens arranged at an open end of the main body opposite to the closed end along the axis; and with light beam adjusting means arranged between the light source and the objective lens for intercepting the light beam, which are movable along the axis of the main body.

11 Claims, 2 Drawing Sheets

STAGE LIGHT

BACKGROUND OF THE INVENTION

A known type of stage light comprises a main body extending along a longitudinal axis; a light source, arranged inside the main body at a closed end of the main body and adapted to emit a light beam substantially along the axis; an objective lens arranged at an open end of the main body opposite to the closed end along the axis; and light beam filtering and/or shaping means arranged between the light source and the objective lens so as to intercept the light beam.

The light beam filtering and/or shaping means are adapted to obtain particular effects on the light beam, and generally comprise light beam coloring assemblies, a diaphragm, which is simply an opaque disk having a central hole of variable dimensions, which limits the diameter of the light beam emitted by the stage light, and gobos, which are disks, typically made of stainless steel or glass, in which a motif or a shape adapted to generate a light pattern, when the gobo intercepts the light beam, is obtained.

The objective lens is arranged substantially orthogonally to the axis of the main body, and is moveable along the axis to allow to adjust the position of the focus of the lens with respect to the light beam filtering and/or shaping means.

However, the diameter of the objective lens of this type of stage light is necessarily limited by the presence of a relatively cumbersome support ring of the objective lens as it must accommodate at least part of the objective lens position adjusting mechanism. The size of the objective lens inevitably also limits the size of the light beam emitted by the stage light, with evident disadvantages from the point of view of stage light efficiency.

SUMMARY OF THE INVENTION

It is an object of the present invention to make a stage light which is free from the drawback of the prior art illustrated here; in particular, it is an object of the present invention to make a stage light which is more effective than the stage lights of the prior art and which is, at the same time, simple and cost-effective to make.

In accordance with such objects, the present invention relates to a stage light comprising a main body extending along a longitudinal axis; a light source arranged inside the main body at a closed end of the main body and adapted to emit a light beam substantially along the axis; an objective lens arranged at an open end of the main body opposite to the closed end along the axis; light beam adjusting means arranged between the light source and the objective lens for intercepting the light beam; the light beam adjusting means is movable along the axis of the main body; the stage light being characterized in that the light beam adjusting means comprises at least a gobos assembly.

BRIEF DESCRIPTION OF THE DRAWINGS

Further features and advantages of the present invention will be apparent from the following description of a non-limitative example of embodiment thereof, with reference to the figures in the accompanying drawings, in which.

DETAILED DESCRIPTION OF THE INVENTION

Figure 1:
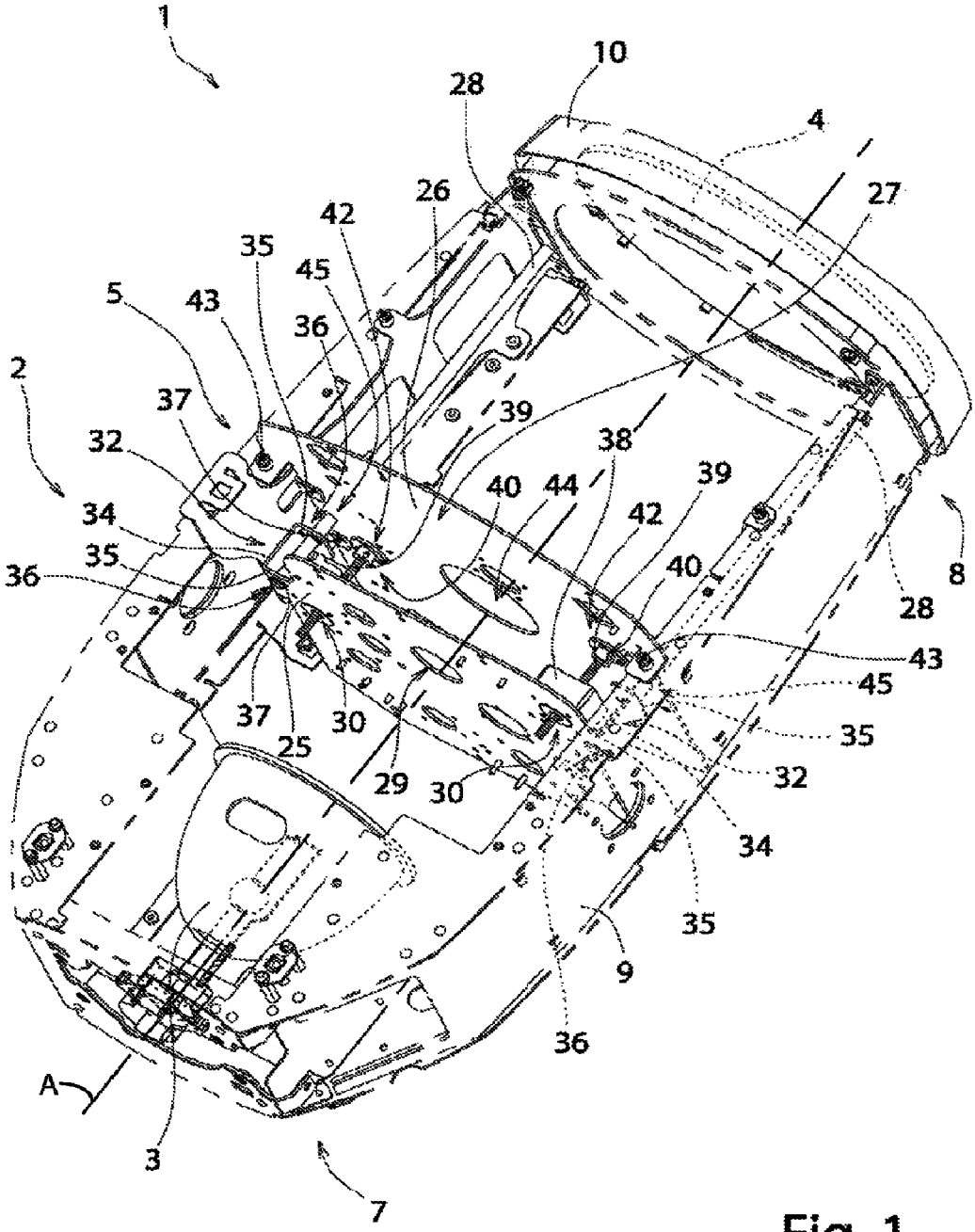
FIG. 1 is a perspective view, with parts removed for clarity, of the stage light according to the present invention.
Figure 2:
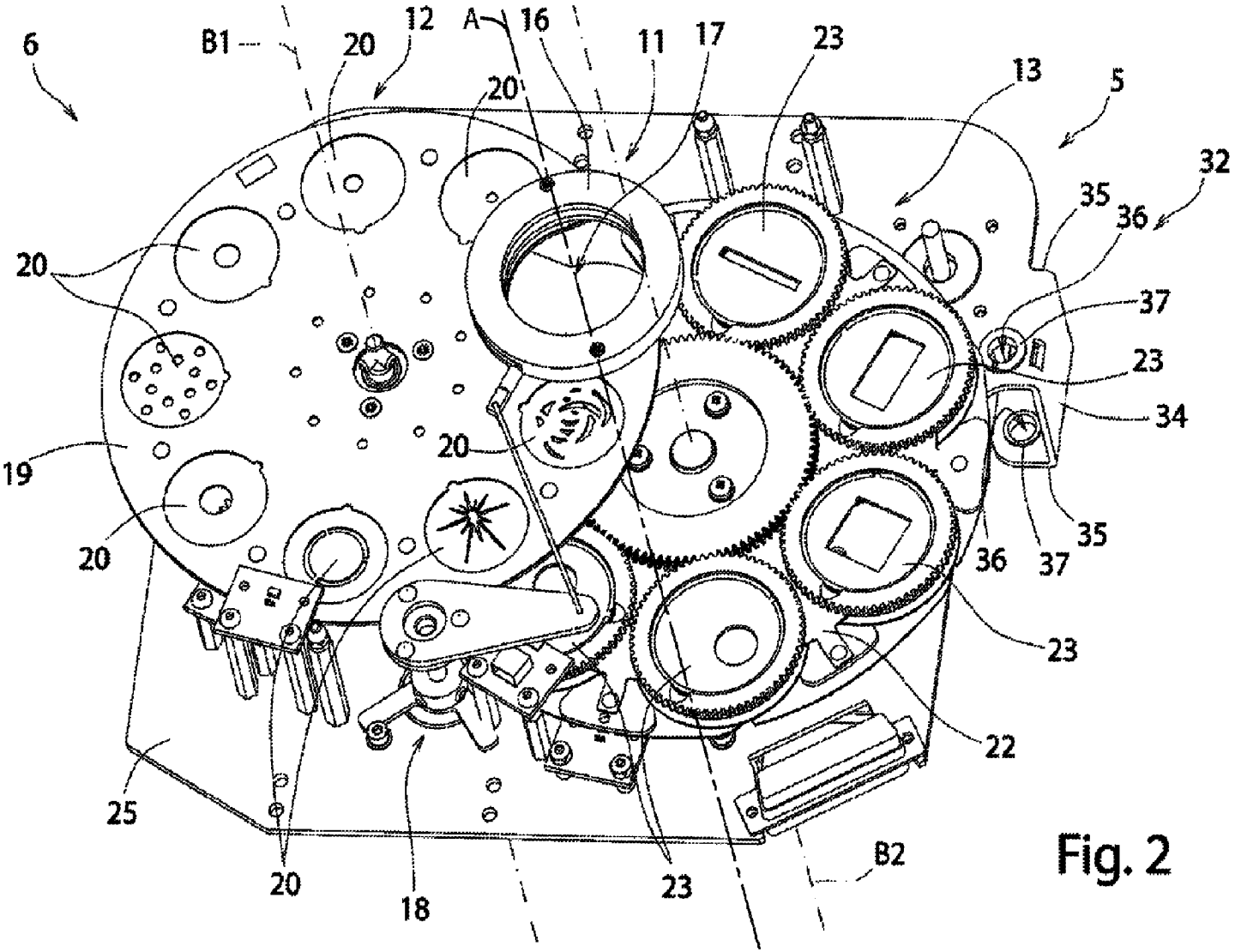
FIG. 2 is a perspective view, with parts removed for clarity, of a detail of the stage light according to the present invention.

In FIG. 1, numeral 1 indicates a stage light comprising a main body 2, a light source 3, an objective lens 4 and a support frame 5 of the light beam adjusting means 6 (shown in FIG. 2).

The main body 2 extends along a longitudinal axis A and presents a closed end 7 and an open end 8 opposite to the closed end along the axis A. In particular, the main body 2 comprises an external casing (not shown for the sake of simplicity in the accompanying figures) and a load-bearing structure 9.

The light source 3 is arranged within the main body 2 at the closed end 7 of the main body 2 and is adapted to emit a light beam substantially along the axis A.

The objective lens 4 is circular and fixed to the open end 8 of the main body 2 so as to be centred on the axis A and close the main body 2. In particular, the objective lens 4 is fixed to a support ring 10, which is fixed to the load-bearing structure 9 of the main body 2, e.g. by means of screws.

The support frame 5 of the light beam adjusting means 6 is arranged within the main body 2 between the light source 3 and the objective lens 4 so that the light beam adjusting means 6 intercept the light beam.

With reference to FIG. 2, the light beam adjusting means 6 essentially comprise elements adapted to obtain particular light beam filtering and/or shaping effects, and corresponding actuating devices. In the example described and illustrated here, the light beam adjusting means 6 comprise a diaphragm 11, a fixed gobos assembly 12 and a rotating gobos assembly 13. According to a variant in the present invention (not shown), the light beam adjusting means also comprise a coloring assembly of the light beam, e.g. colored glass actuated by corresponding actuating devices.

The diaphragm 11 is adapted to limit the diameter of the light beam which is emitted by the stage light 1 and comprises an opaque disk 16 having a central hole 17 of variable dimensions. The disk 16 is indeed connected to an adjustment mechanism 18, which when actuated either broadens or narrows the central hole 17 of the diaphragm 11.

The fixed gobos assembly 12 comprises a gobos holder wheel 19 rotatable about an axis B1 and provided with a plurality of seats adapted to accommodate corresponding fixed gobos 20.

The rotating gobos assembly 13 comprises a gobos holder wheel 22 rotatable about an axis B2 and provided with a plurality of seats adapted to accommodate corresponding rotating gobos 23. The fixed gobos 20 and the rotating gobos 23 are disks, typically made of stainless steel or glass, in which a motif or shape is either obtained or drawn adapted to generate a light pattern when the gobo 20 or the gobo 23 intercepts the light beam.

The diaphragm 11, the fixed gobos assembly 12 and the rotating gobos assembly 13 are fixed to the support frame 5 and are arranged substantially aligned along the axis A.

With reference to FIG. 1, the support frame 5 comprises a carriage 25 supporting the light beam adjusting means 6 (FIG. 2), a fixed plate 26 arranged between the carriage 25 and the objective lens 4, actuating means 27 of the carriage 25 and two guides 28 for the sliding of the carriage 25.

The carriage 25, in the case in point, is a preferably metallic plate having a substantially quadrangular shape and is provided with a main hole 29 for the passage of the light beam, with a plurality of holes 30 for accommodating and fixing the actuating means 27 and with a plurality of holes of variable size for fixing the adjusting means of the light beam 6 (FIG. 2). The carriage 25 is arranged substantially orthogonal to the axis A and is provided with two U-shaped fins 32. In particular, each fin 32 is provided with a bottom wall 34 and two side walls 35 orthogonal to the bottom wall 34 and correspondingly provided with a preferably circular section through hole 36. The fins 32 respectively protrude from two opposite sides of the carriage 25, so that the side walls 35 are arranged substantially orthogonal to the axis A.

The holes 36 of each fins 32 are adapted to be slidingly engaged by a corresponding guide 28, which is fixed to the load-bearing structure 9 of the main body 2. Preferably, each hole 36 is provided with a bushing 37 (more clearly shown in FIG. 2) for facilitating the sliding of the carriage 25 along the guide 28 and preventing excessive wear of the holes 36 of the fins 32 of the carriage 25.

The actuating means 27 of the carriage 25 comprise two electric motors 38 fixed to the carriage 25. The shaft of each motor 38 is a worm screw 39, which crosses a corresponding hole 30 of the carriage 25 and is fixed to an end 40 of the fixed plate 26 by means of a flange 42.

According to a variant of the present invention (not shown), the motors 38 are electric motors with belt drive.

Each motor 38 is electronically controlled by a microprocessor.

The fixed plate 26 is fixed to the load-bearing structure 9 of the main body 2, e.g. by two screws 43, and is preferably made of metallic material.

The fixed plate 26 is provided with a central hole 44 for the passage of the light beam, two side holes 45 adapted to be engaged by the guides 28, and a plurality of holes for fixing light beam processing means (not shown in the accompanying figures), e.g. a dimmer, lens, etc.

The controlled actuation of the motors 38 determines the movement of the carriage 25 along axis A between a plurality of positions. In each position of the plurality of positions, at least one of the light beam adjusting means 6 is at the focus of the objective lens 4.

In the non-limitative example described and illustrated here, the carriage 25 essentially moves between three different positions. A first position, in which the diaphragm 11 is arranged at the focus of the objective lens 4, a second position, in which the fixed gobos assembly 12 is arranged at the focus of the objective lens 4, and a third position in which the rotating gobos assembly 13 is arranged at the focus of the objective lens 4.

According to a variant of the present invention (not shown), the carriage 25 may also assume a fourth position, in which a coloring assembly of the light beam is arranged at the focus of the objective lens 4.

Advantageously, the stage light 1 according to the present invention has an objective lens 4 of larger size than that of the known stage lights of the same size. Indeed, the elimination of the adjustment mechanism of the objective lens 4 allows to minimize the dimensions of the support ring 10 and to maximize the size of the objective lens 4. The adjustment effect of the position of the light beam adjusting means is exclusively obtained by moving the support frame 5.

It is finally apparent that changes and variations may be made to the stage light described here without departing from the scope of the accompanying claims.

The invention claimed is:

1. A stage light fixture comprising:

a main body extending along a longitudinal axis;

a light source arranged inside the main body at a closed end of the main body and suitable to emit a light beam substantially along the longitudinal axis;

an objective lens arranged at an open end opposite to the closed end along the axis;

at least one light beam adjusting means including a gobos assembly, the at least one light beam adjusting means arranged between the light source and the objective lens intercepting the light beam; the light beam adjusting means including the gobos assembly being movable along the longitudinal axis of the main body; and a support frame that supports the at least one light beam adjusting means, the support frame comprising a carriage that is movable along the longitudinal axis of the main body and supports the at least one light beam adjusting means, the carriage being movable along the longitudinal axis between a plurality of positions; in each position of the plurality of positions, at least one of the at least one light beam adjusting means is arranged at a focus of the objective lens.

2. The light fixture according to claim 1, wherein the carriage is arranged substantially orthogonal to the longitudinal axis of the main body.

3. The light fixture according to claim 2, wherein the support frame comprises tracks which are substantially parallel to the longitudinal axis and fixed to the main body; the carriage being slidable along the tracks.

4. The light fixture according to claim 1, wherein the support frame comprises driving means for driving the carriage.

5. The light fixture according to claim 4, wherein the driving means comprise at least a motor.

6. The light fixture according to claim 5, wherein the motor comprises an electric motor having a motor shaft, with at least a portion of the motor shaft being a worm screw.

7. The light fixture according to claim 5, wherein the motor comprises an electric motor provided with a belt transmission.

8. The light fixture according to claim 1, wherein the objective lens is fixed to the main body.

9. The light fixture according to claim 1, wherein the at least one light beam adjusting means comprises a diaphragm.

10. The light fixture according to claim 1 wherein the at least one light beam adjusting means comprises a light beam coloring assembly.

11. A stage light fixture comprising:

a main body extending along a longitudinal axis, the main body including a closed end and an opposing open end;

a light source arranged inside the main body at the closed end and configured to emit a light beam substantially along the longitudinal axis;

an objective lens arranged at the open end along the longitudinal axis;

at least one light beam adjusting device including a gobos assembly, the at least one light beam adjusting device arranged between the light source and the objective lens to intercept the light beam; the at least one light beam adjusting device including the gobos assembly being movable along the longitudinal axis of the main body; and a support frame that supports the at least one light beam adjusting device, the support frame comprising a carriage that is movable along the longitudinal axis of the main body and supports the at least one light beam adjusting device, the carriage being movable along the longitudinal axis between a plurality of positions; in each position of the plurality of positions, at least one of the at least one light beam adjusting device is arranged at a focus of the objective lens.

* * * * *